US009873014B1

(12) United States Patent
Kuo

(10) Patent No.: US 9,873,014 B1
(45) Date of Patent: Jan. 23, 2018

(54) ARM AND LEG COMPOUND EXERCISE MACHINE

(71) Applicant: SportsArt Industrial Co., Ltd., Tainan (TW)

(72) Inventor: Hai-Pin Kuo, Tainan (TW)

(73) Assignee: SPORTSART INDUSTRIAL CO., LTD., Tainan (TW)

( * ) Notice: Subject to any disclaimer, the term of this patent is extended or adjusted under 35 U.S.C. 154(b) by 0 days.

(21) Appl. No.: 15/368,586

(22) Filed: Dec. 3, 2016

(51) Int. Cl.

| | |
|---|---|
| ***A63B 24/00*** | (2006.01) |
| ***A63B 22/00*** | (2006.01) |
| ***A63B 21/005*** | (2006.01) |
| ***A63B 21/00*** | (2006.01) |
| ***A63B 22/06*** | (2006.01) |
| ***A63B 23/035*** | (2006.01) |

(52) U.S. Cl.
CPC ..... *A63B 22/0015* (2013.01); *A63B 21/0058* (2013.01); *A63B 21/154* (2013.01); *A63B 21/4034* (2015.10); *A63B 21/4035* (2015.10); *A63B 22/001* (2013.01); *A63B 22/0664* (2013.01); *A63B 23/03591* (2013.01); *A63B 2022/067* (2013.01)

(58) Field of Classification Search
CPC ..... A63B 22/0015; A63B 22/001; A63B 22/0664; A63B 21/0058; A63B 21/154; A63B 21/4035; A63B 21/4034; A63B 23/03591; A63B 2022/067
See application file for complete search history.

(56) References Cited

U.S. PATENT DOCUMENTS

| | | | | |
|---|---|---|---|---|
| 9,597,540 | B2 * | 3/2017 | Arnold | A63B 21/0052 |
| 9,707,439 | B2 * | 7/2017 | Lee | A63B 22/001 |
| 9,757,614 | B1 * | 9/2017 | Giannelli | A63B 22/0017 |
| 2017/0106231 | A1 * | 4/2017 | Liao | A63B 22/0015 |

* cited by examiner

*Primary Examiner* — Glenn Richman

(57) ABSTRACT

Disclosed is an arm and leg compound exercise machine using a pair of crank units and a lifting device to adjust leg motion track and exercise tension and allow users to timely adjust the exercise strength for leg exercise. When a foot pedal installed onto the arm and leg compound exercise machine is operated, the motion track produced by the foot pedal is an elliptic motion path, and the elliptic motion track is flat and gentle at the top and arc shaped at the bottom, so that the motion track produced by the users' stepping motion is ergonomic for preventing sports injuries.

6 Claims, 10 Drawing Sheets

ARM AND LEG COMPOUND EXERCISE MACHINE

FIELD OF INVENTION

The present invention relates to an arm and leg compound exercise machine, in particular to the arm and leg compound exercise machine capable of adjusting leg motion track and exercise tension.

BACKGROUND OF INVENTION

1. Description of the Related Art

Although the nature of using indoor exercise equipments differs from outdoor exercises, indoor exercise equipments in different areas are capable of training various muscles of a human body. Physical trainings can take place at home or in an indoor environment to achieve the purposes of fitness or rehabilitation. Therefore, indoor exercise equipments such as treadmills, steppers, rowers, and fitness bikes become popular, and consumers generally select and use indoor exercise equipments, and indoor exercise equipments are constantly developed in recent years. Among these indoor exercise equipments, the exercise machine with a motion track is the most favorite one to consumers. However, the conventional exercise machines basically have the effect of training physical fitness, but the motion track formed by the conventional exercise machines is in single mode and the motion track cannot be adjusted. In addition, users have to step according to the stepping track of the exercise machines. If the stepping track of the exercise machine is not good, then leg muscle soreness and long-term accumulated sport injuries may occur.

2. Summary of the Invention

Therefore, it is a primary objective of the present invention to provide an arm and leg compound exercise machine, the arm and leg compound exercise machine capable of using a pair of crank units and a lifting device to adjust leg motion track and exercise tension, so that users can timely adjust the exercise strength of their leg exercise and when a foot pedal installed onto the arm and leg compound exercise machine is operated, the motion track produced by the foot pedal is an elliptic motion path, and the elliptic motion track is flat and gentle at the top and arc shaped at the bottom, so that the motion track produced by the users' stepping motion is ergonomic for preventing sports injuries.

Another objective of the present invention is to provide an arm and leg compound exercise machine, and the arm and leg compound exercise machine has a motion unit pivotally coupled to a base, and a transmission unit coupled to the base, and the motion unit further comprises two pivoting brackets, two swing grips, two upper link rods, and two linkage rods which are installed on both sides of the base, and a lower end of the swing grip is installed to an upper end of the pivoting bracket, and the pivoting bracket is pivotally coupled to the second pivot shaft of the base and its pivot point acts as a rotating shaft point, and an upper end of the hollow swing arm is pivotally coupled to the first pivot shaft of the base and its pivot point acts as a rotating shaft point, and an end of the upper link rod is pivotally coupled to a lower end of the pivoting bracket and its pivot point acts as a rotating shaft point, and the other end of the upper link rod is pivotally coupled to the other pivot point of the hollow swing arm and its pivot point acts as a rotating shaft point, so that the swing grip and the hollow swing arm are coupled to each other by the upper link rod and swung synchronously, and an end of the linkage rod is pivotally coupled to a lifting device in the hollow swing arm and its pivot point acts as a rotating shaft point, and the other end of the linkage rod is pivotally coupled to the hinged frame capable of sliding on the sliding set, and the hinged frame is rotationally and pivotally coupled to the connection bar of the crank unit of the transmission unit and its pivot point acts as a rotating shaft point, and a central axis point acts as a center point and has a virtual longitudinal axis extended from the central axis point, and the rotating shaft point of the first pivot shaft and the rotating shaft point of the second pivot shaft are disposed on both lateral sides of the virtual longitudinal axis respectively. The foot pedal at an end of the sliding set is disposed beyond the range of connecting the central axis point and the rotating shaft point at the lower end of the hollow swing arm. When a user wants to adjust the leg motion track, the user simply needs to fine tune the length of the crank unit or the lifting device, so that the exercise tension and motion track produced by the operation of the exercise machine can be adjusted at the foot pedal.

DESCRIPTION OF THE PREFERRED EMBODIMENTS

The above and other objects, features and advantages of this disclosure will become apparent from the following detailed description taken with the accompanying drawings.

Figure 1:
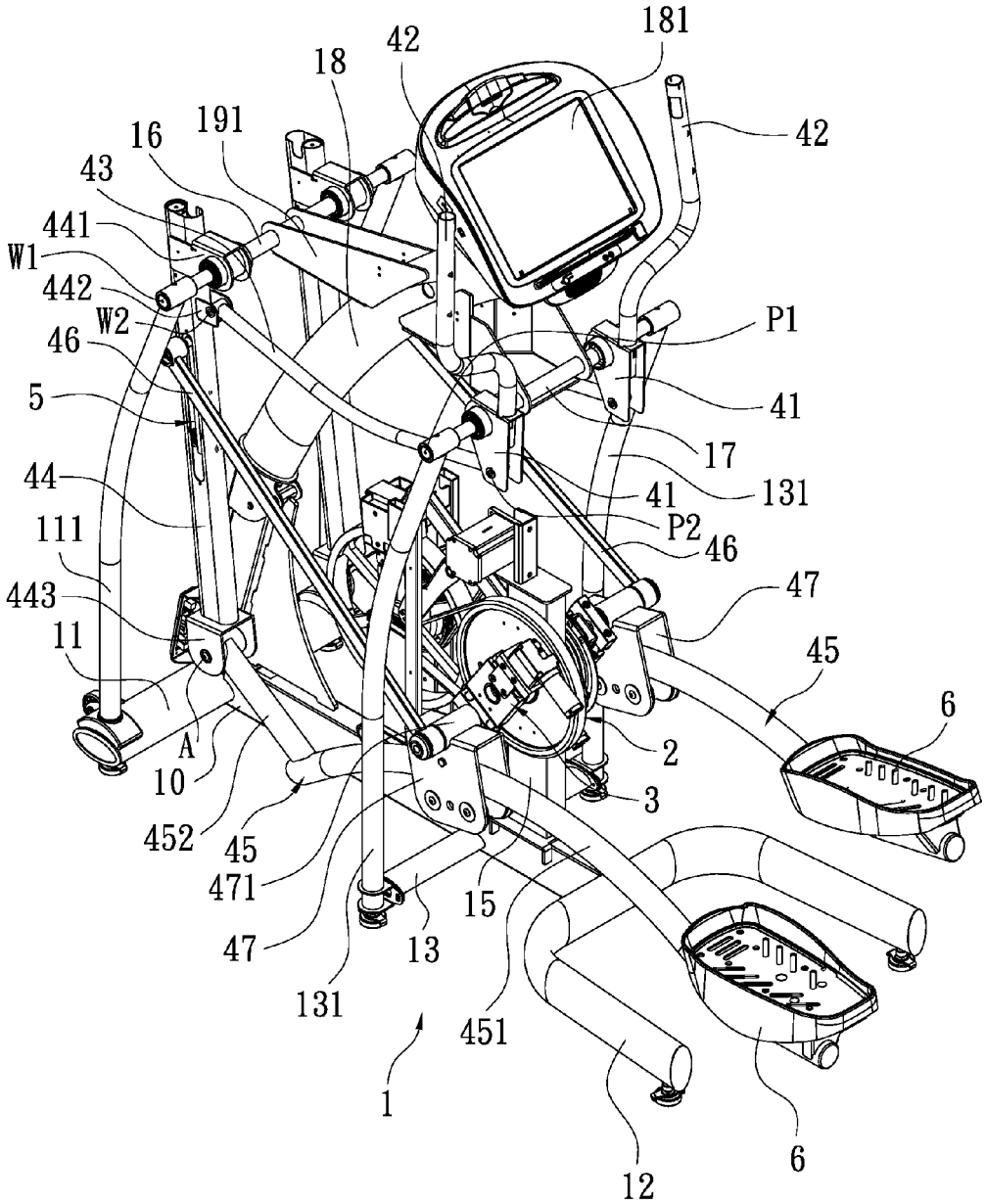
FIG. 1 is a perspective view of an arm and leg compound exercise machine of the present invention.
Figure 2:
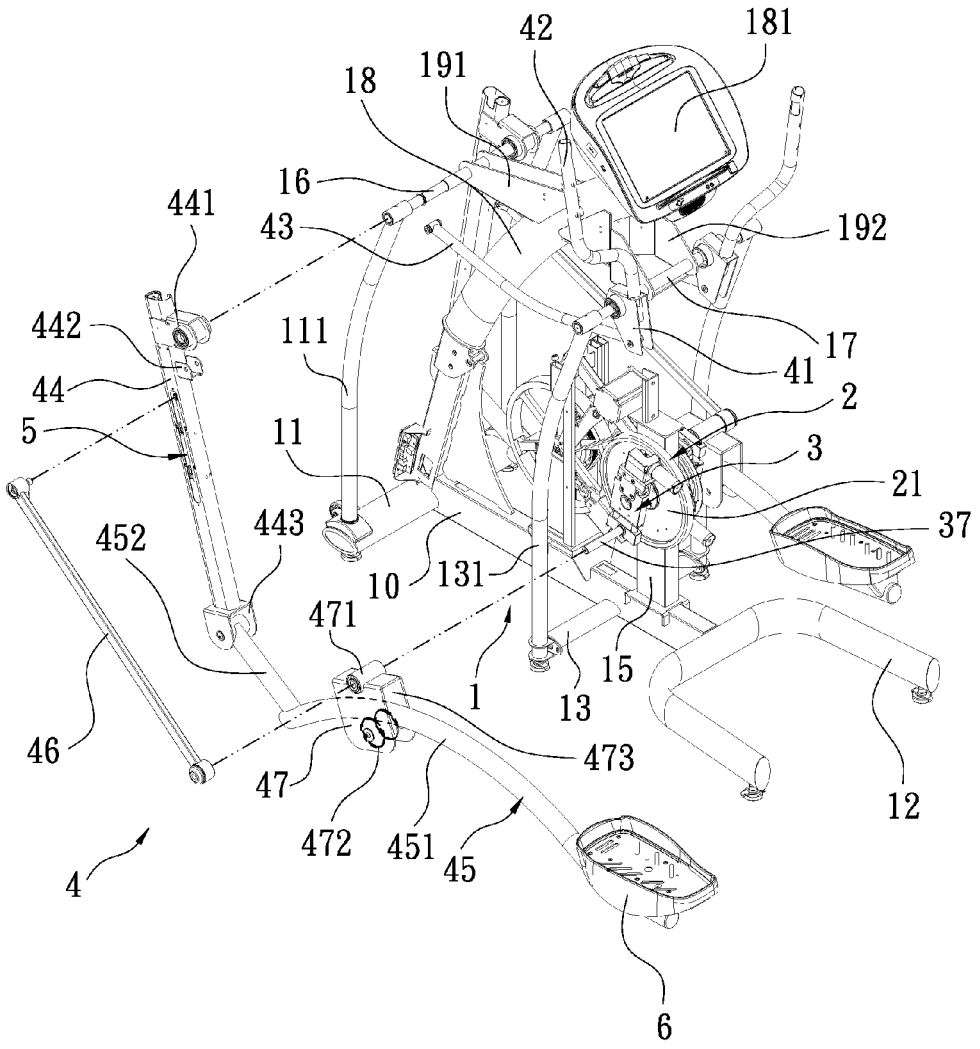
FIG. 2 is an exploded view of an arm and leg compound exercise machine of the present invention.

With reference to FIGS. 1 and 2 for an arm and leg compound exercise machine of the present invention, the arm and leg compound exercise machine comprises a base 1, a transmission device 2, a pair of crank units 3, a separated motion unit 4 and a lifting device 5.

The base 1 comprises a chassis 10, a front cross bar 11 installed at an end of the chassis 10, and a U-shaped rear frame 12 installed at the other end of the chassis 10, a pole 18 extended upwardly from a center position of the front cross bar 11, a console 181 installed at an end of the pole 18, a front connection stand 191 and a rear connection stand 192 extended horizontally from both front and rear sides of the pole 18 near the console 181, a first pivot shaft 16 pivotally coupled to the front connection stand 191, a second pivot shaft 17 pivotally coupled to the rear connection stand 192, a front vertical bar 111 extended upwardly from each of both sides of the front cross bar 11, and an end of the front vertical bars 111 being coupled to the first pivot shaft 16, a side bar 13 being extended from each of both sides of the chassis 10 and substantially from the middle of the chassis 10, a rear vertical bar 131 extended upwardly from each end of the side bar 13 and coupled to the second pivot shaft 17, and a plurality of brackets mounted on to the chassis 10.

Figure 3:
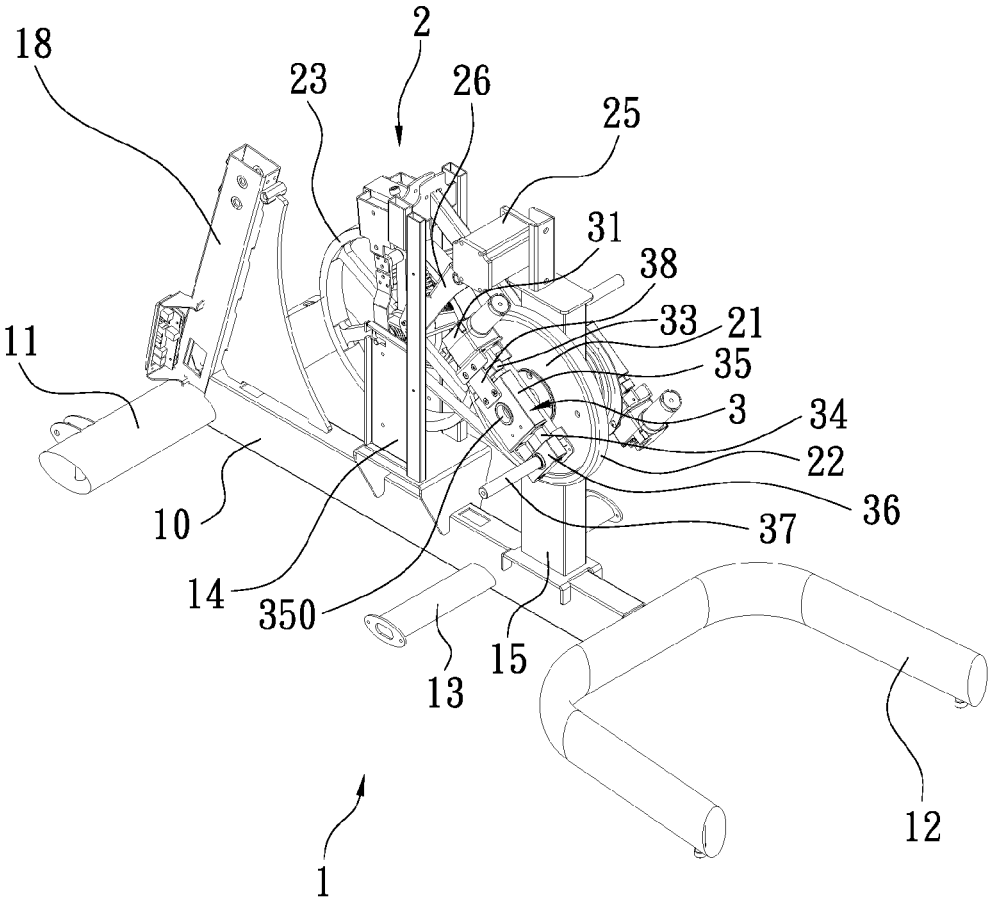
FIG. 3 is a perspective view of a transmission unit pivotally coupled to a base in accordance with the present invention.
Figure 4:
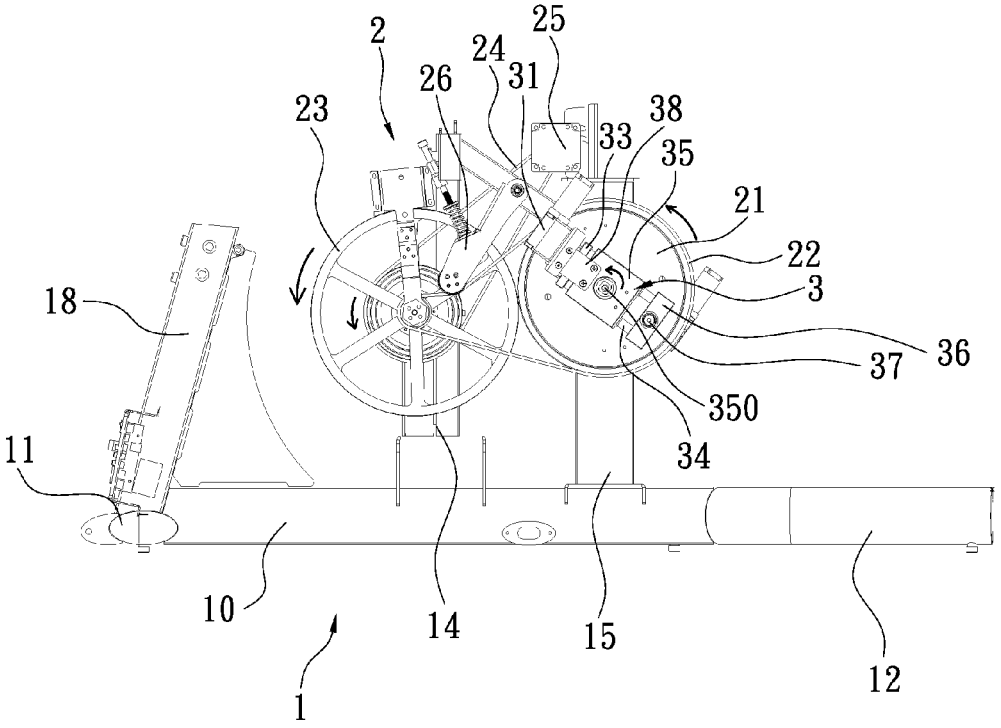
FIG. 4 is a side view of a transmission unit pivotally coupled to a base in accordance with the present invention.

With reference to FIGS. 3 and 4, the transmission device 2 is installed to the plurality of brackets of the base 1, and the brackets are a front bracket 14 and a rear bracket 15, and the transmission device 2 comprises a pulley 21, a belt 22, a cast wheel 23, a belt 24, a generator motor 25 and an idler set 26, and the pulley 21 is installed to the rear bracket 15, and the cast wheel 23 is installed to the front bracket 14, and one of the belts 22 is sheathed and coupled to the pulley 21 and an axle of the cast wheel 23, and the idler set 26 abuts against an outer side of the belt 22 and is capable of absorbing a vibration force generated by the operation of the belt 22 to reduce transmission noise and improve service life, and the generator motor 25 may be installed on the rear bracket 15, and the generator motor 25 is coupled to an axle of the cast wheel 23 by the other belt 24. When the pulley 21 links the cast wheel 23 to rotate, the cast wheel 23 is linked by the belt 24 to drive the generator motor 25 to generate electric energy.

Figure 5:
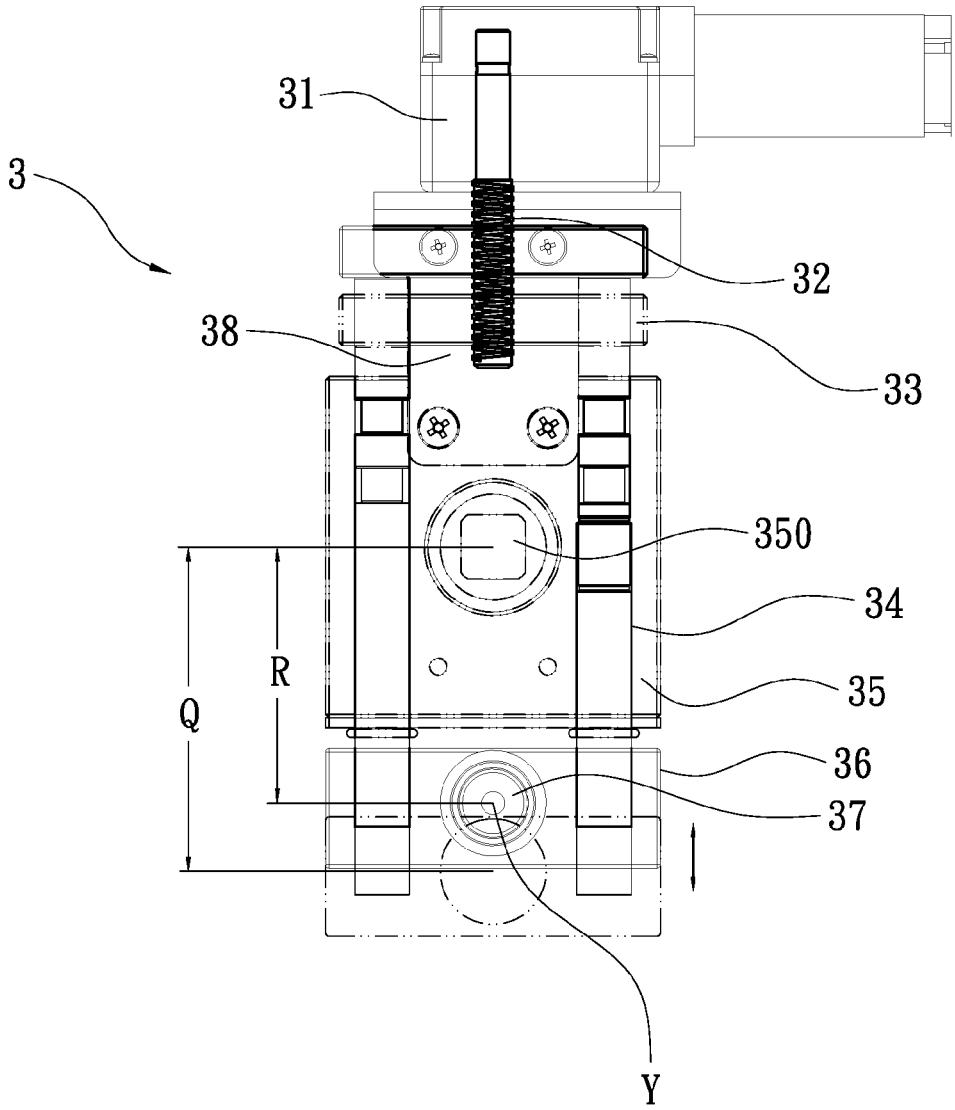
FIG. 5 is a schematic planar view showing the operation of a crank unit of the present invention.
Figure 6:
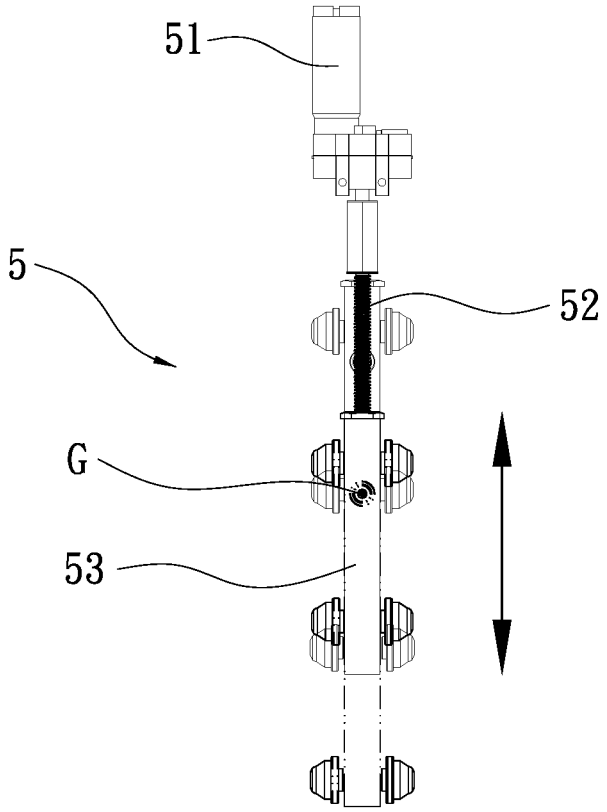
FIG. 6 is a schematic planar view showing the operation of a lifting device of the present invention.

With reference to FIGS. 3 to 5, the pair of crank units 3 are rotationally installed to both sides of the axle of the pulley 21 of the transmission device 2 respectively, and the crank unit 3 comprises a motor 31, a screw 32 extended from the motor 31 and screwed and penetrating through a connection block 33, and at least one slide bar 34 is locked to the connection block 33 and capable of slidably penetrating through a fixed casing 35, and the other end of the slide bar 34 is fixed to an adjusting block 36, and a locking plate 38 is provided for coupling and fixing the motor 31 and the fixed casing 35, and the fixed casing 35 has a shaft hole 350 and is rotationally installed to an axle of the pulley 21 of the transmission device 2, and the axle of the pulley 21 acts as a central axis point C, and a connection bar 37 is extended upwardly from the adjusting block 36. When the motor 31 drives the screw 32 to rotate, and the rotating screw 32 drives the connection block 33 to displace, so as to slide the connection block 33 fixed to the slide bar 34 in the fixed casing 35, and the sliding of the slide bar 34 drives the adjusting block 36 for a radial movement to adjust the crank length of the crank unit 3.

Figure 7:
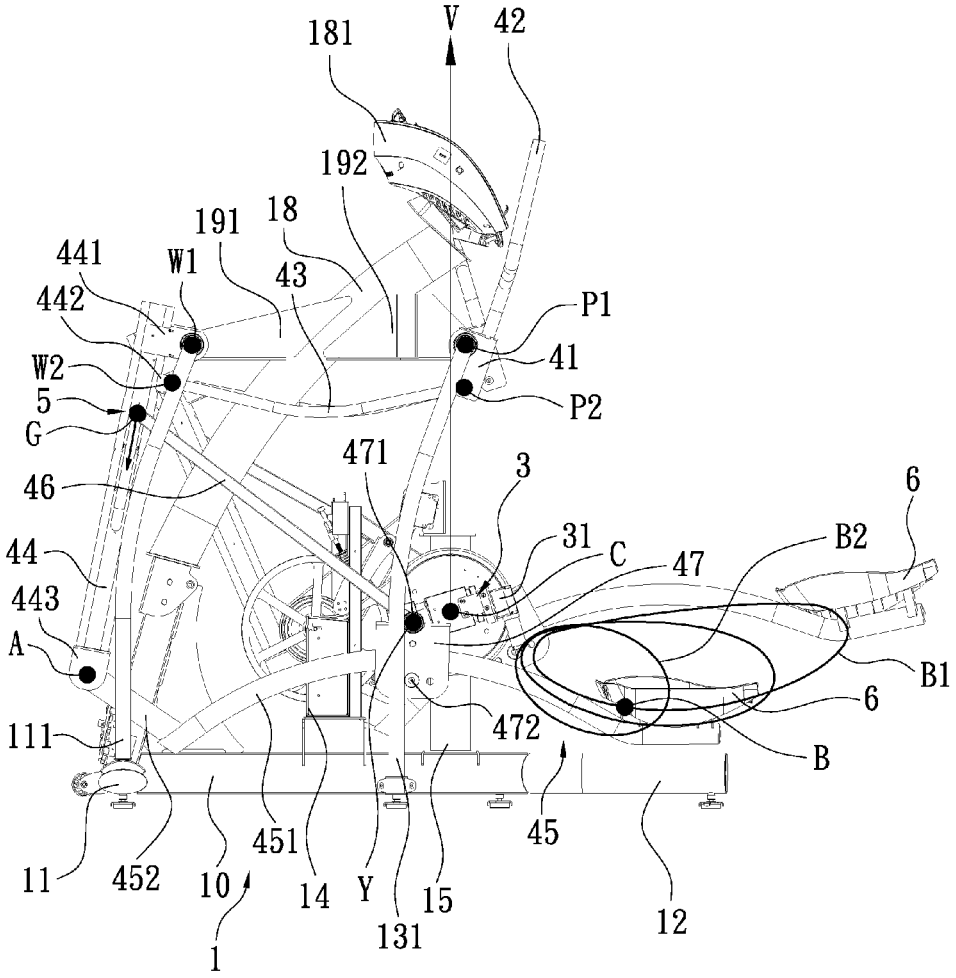
FIG. 7 is a schematic view of a lifting device and the motion track produced by adjusting the lifting device.

With reference to FIGS. 1, 2 and 7, a motion unit 4 is pivotally coupled to the base 1 and also coupled to the transmission unit 2, and the motion unit 4 includes two pivoting brackets 41, two swing grips 42, two upper link rods 43, two hollow swing arms 44, two sliding sets 45, two linkage rods 46, two hinged frames 47, and two foot pedals 6 installed to both sides of the base 1, wherein the lower end of the swing grip 42 on one side is installed to the upper end of a pivoting bracket 41, and the pivoting bracket 41 is pivotally installed to the second pivot shaft 17 of the base 1, and its pivot point acts as a rotating shaft point $P_1$, and an upper pivot seat 441 is installed at the upper end of the hollow swing arm 44 and pivotally coupled to the first pivot shaft 16 of the base 1, and its pivot point acts as a rotating shaft point $W_1$, and an end of the upper link rod 43 is pivotally coupled to the lower end of the pivoting bracket 41, and its pivot point acts as a rotating shaft point $P_2$, and the other end of the upper link rod 43 is pivotally coupled to the other pivot seat 442 of the hollow swing arm and its pivot point acts as a rotating shaft point $W_2$, so that the swing grip 42 and the hollow swing arm 44 are coupled to each other by the upper link rod 43 and swung synchronously, and a lower end of the hollow swing arm 44 has a lower pivot seat 443.

The sliding set 45 includes an arc slide bar 451 and a short rod 452, and an end of the short rod 452 is pivotally coupled to the lower pivot seat 443 and its pivot point acts as a rotating shaft point A, and the arc slide bar 451 is extended from the other end of short rod 452, and an end of the arc slide bar 451 has a foot pedal 6. An end of the linkage rod 46 is pivotally coupled to the lifting device 5 in the hollow swing arm 44 and its pivot point acts as a rotating shaft point G.

The hinged frame 47 is physically an n-shaped hinged frame 47, and a pivot seat 471 is installed at an upper end of the hinged frame 47, and a roller 472 is installed in the hinged frame 47, and a receiving space 473 is defined between the hinged frame 47 and the roller 472, and the other end of the linkage rod 46 is pivotally installed to the pivot seat 471 of the hinged frame 47, and the pivot seat 471 is rotationally and pivotally coupled to the connection bar 37 of the crank unit 3 and its pivot point acts as a rotating shaft point Y. With reference to FIG. 7, the sliding set 45 and the connection bar 37 of the crank unit 3 have different shaft points, and the arc slide bar 451 of the sliding set 45 slides in the receiving space 473 between the hinged frame 47 and the roller 472, and a distance exists between the roller 472 and the pivot seat 471, so that when the foot pedal 6 is operated to drive the crank unit 3 to rotate, the motion path produced by the roller 472 of the hinged frame 47 is a non-circular motion track F (also refer to FIG. 8). In other words, the arc slide bar 451 of the sliding set 45 sliding in the hinged frame 47 has a motion path which is also a non-circular motion track.

With reference to FIGS. 2 and 6 to 9, the lifting device 5 is installed in the hollow swing arm 44, and the lifting device 5 comprises a motor 51 and a screw 52 extended from the motor 51 and screwed with a lifting bar 53, and an end of the linkage rod 46 is pivotally coupled to the lifting bar 53 of the lifting device 5 and its pivot point acts as a rotating shaft point G, and the motor 51 drives the screw 52 to rotate, and the rotating screw 52 drives the lifting bar 53 to displace, so as to allow the rotating shaft point G to move linearly to adjust the axial position of the rotating shaft point G.

With reference to FIG. 7, the present invention uses the axle of the pulley 21 which is coaxial to the rotating axis of the crank unit 3 as a central axis point C having a virtual longitudinal axis V extended from the central axis point C, and the rotating shaft point $W_1$ of the first pivot shaft 16 and the rotating shaft point $P_1$ of the second pivot shaft 17 are disposed on both lateral sides of the virtual longitudinal axis V respectively, and the foot pedal 6 at an end of the sliding set 45 is disposed beyond the range from connecting the central axis point C and the rotating shaft point A at a lower end of the hollow swing arm 44. In other words, the hollow swing arm 44 and the rotating shaft point A of the sliding set 45 and the foot pedal 6 at an end of the sliding set 45 are disposed on both lateral sides of the virtual longitudinal axis V respectively. When a user steps on the foot pedal 6 of the arm and leg compound exercise machine, the motion path produced by the foot pedal 6 acts as a motion track B, and the motion track B produced by the foot pedal 6 is an elliptic motion path (also refer to FIG. 7), and the elliptic motion path is the motion track B gentle at the top and arc shaped at the bottom, so that the motion track B produced by the stepping movement is ergonomic and capable of preventing sports injuries.

When the user wants to adjust the leg motion track, the user simply needs to fine tune the length of the crank unit 3 or the lifting device 5, so that the exercise tension and motion track B produced by the operation of the exercise machine can be adjusted at the foot pedal 6 as shown in FIGS. 7 to 10.

Figure 8:
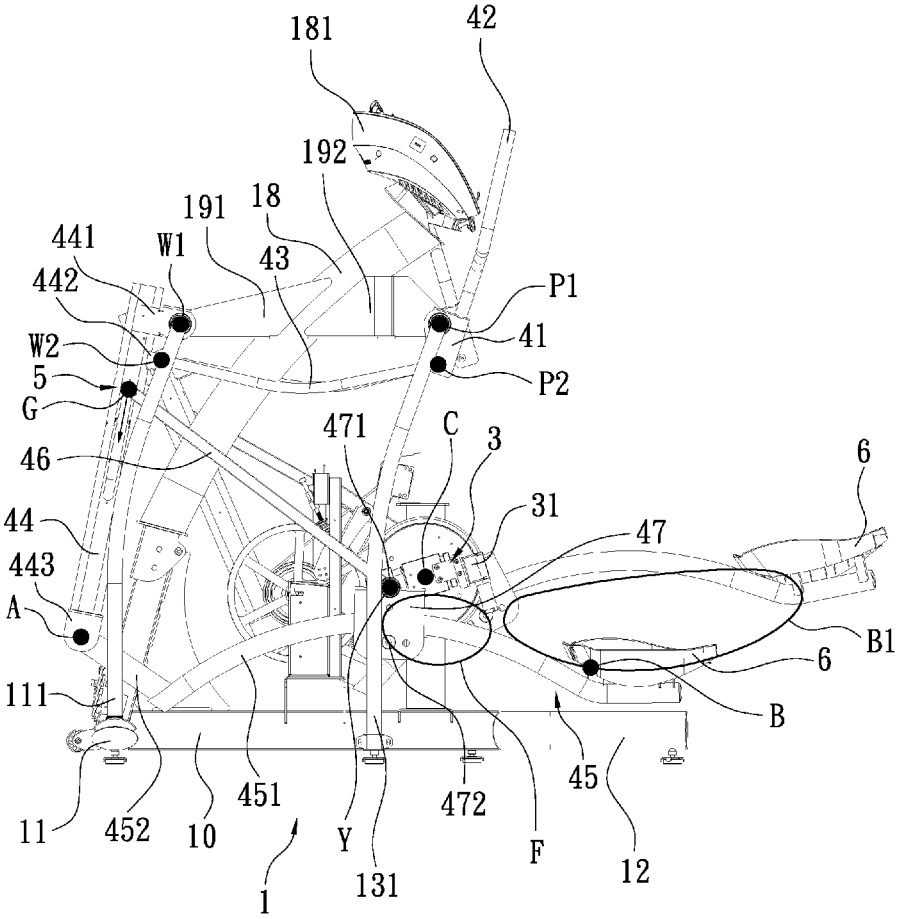
FIG. 8 is a schematic view of a lifting device adjusted to the highest point in accordance with the present invention.
Figure 9:
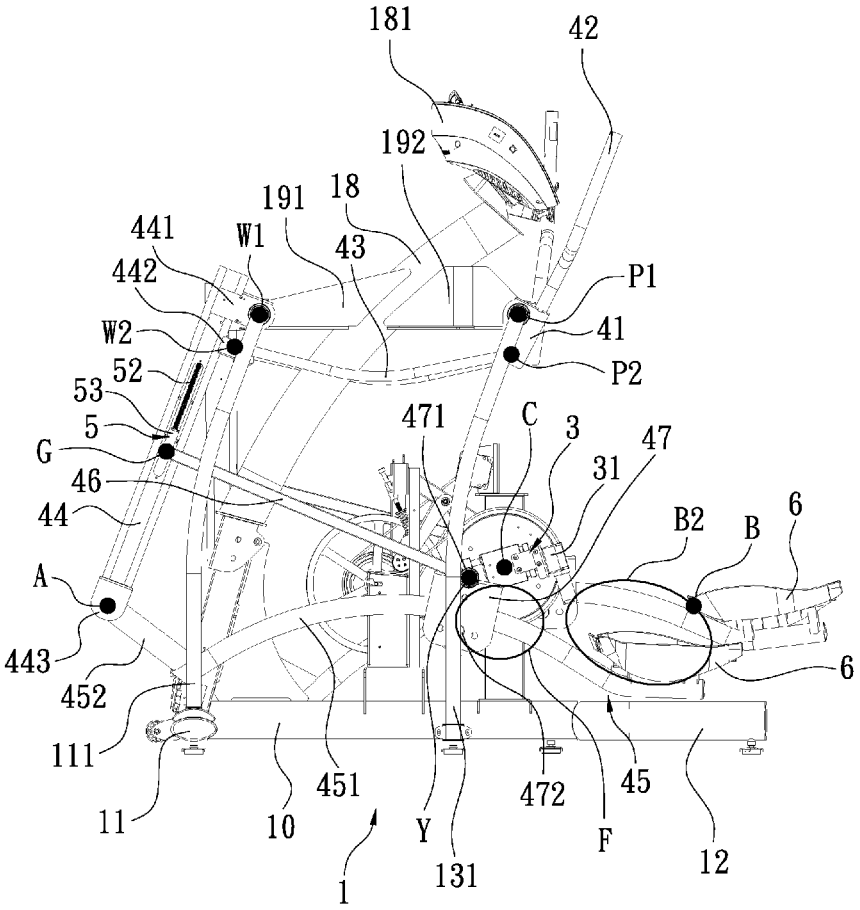
FIG. 9 is a schematic view of a lifting device adjusted to the lowest point in accordance with the present invention.

In FIGS. 7 to 9, when the rotating shaft point G of the lifting device 5 is disposed at the highest point of the adjusting range of the lifting device 5, the motion track B produced by the operation of the foot pedal 6 is the elliptic motion track $B_1$ with the largest exercise tension and strength as shown in FIG. 8. When the rotating shaft point G is adjusted progressively to the lowest point of the axial position, the motion track B produced by the operation of the foot pedal 6 is the elliptic motion track $B_2$ with an upwardly tilted angle, and the elliptic motion track $B_2$ is similar to a uphill climbing exercise mode as shown in FIG. 9.

Figure 10:
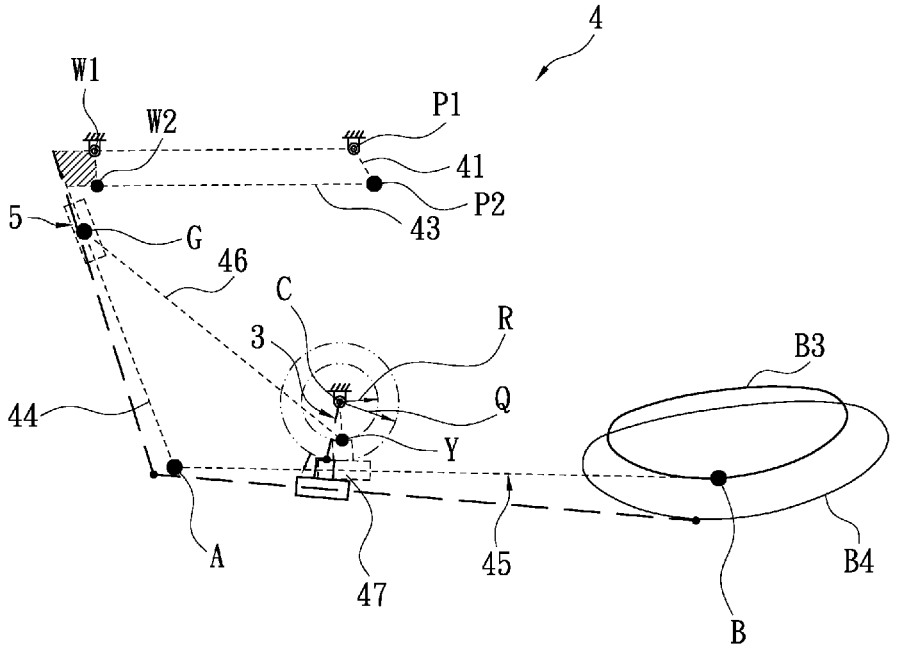
FIG. 10 is a schematic view of a crank unit and a motion track produced by adjusting the crank unit.

With reference to FIGS. 5 and 10, after the motor 31 of the crank unit 3 is driven, the screw 32 extended from the motor 31 is rotated, and the rotating screw 32 allows the connection block 33 to have a displacement to link the fixed slide bar 34 and adjusting block 36 for a radial movement. In other words, the rotating shaft point Y pivotally coupled to the connection bar 37 of the adjusting block 36 and the hinged frame 47 and central axis point C of the crank unit 3 has an adjustable radial length. When the crank length from the rotating shaft point Y to the central axis point C is the smallest length R, the motion track B produced by the operation of the foot pedal 6 is the elliptic motion track $B_3$ with the smallest exercise tension and strength. When the crank length from the rotating shaft point Y and the central axis point C is adjusted progressively to the largest length Q, the motion track B produced by the operation of the foot pedal 6 is an elliptic motion track $B_4$.

In summation of the description above, the arm and leg compound exercise machine may adjust the leg motion track and exercise tension by a pair of crank units 3 and a lifting device 5, so that the users can timely adjust the exercise strength of their leg exercise. When a user steps on the foot pedal 6 of the arm and leg compound exercise machine, the motion track B produced by the foot pedal 6 is an elliptic motion path, wherein the elliptic motion path is a motion track gentle at the top and arc shaped at the bottom, so that the motion track produced by the stepping movement is ergonomic, so as to prevent sports injuries.

What is claimed is:

1. An arm and leg compound exercise machine, comprising:

a base, disposed on a horizontal ground;

a transmission device, installed onto the base, and including a pulley;

a pair of crank units capable of adjusting a crank length, including a pair of fixed casings and a pair of adjusting blocks, and the pairs of fixed casings being rotationally installed to both sides of an axle of the pulley of the transmission device, and the axle of the pulley being used as a central axis point, and the adjusting block having a crank length from the central axis point and a connection bar extended from the adjusting block;

a motion unit, including two hollow swing arms, two sliding sets, two hinged frames, and two foot pedals installed on both sides of the base, and a pivot seat disposed on the hinged frame being rotationally and pivotally coupled to a connection bar of the crank unit disposed on the transmission unit, and the hollow swing arm having a lower end pivotally coupled to a sliding set, and the pivot point acting as a rotating shaft point, and the sliding set having a foot pedal disposed at an end of the sliding set and disposed beyond the range of connecting the central axis point and the rotating shaft point at the lower end of the hollow swing arm, and the arc slide bar of the sliding set being disposed and sliding in a receiving space between the hinged frame and a roller installed therein, and a distance existing between the roller and the pivot seat, so that the sliding set and the connection bar of the crank unit have different axle points, and when the foot pedal is operated to drive the crank unit to rotate, the motion path produced by the roller on the hinged frame is a non-circular motion track;

when a user steps on the foot pedal of the arm and leg compound exercise machine for operation, the motion path produced by the foot pedal acts as a motion track, and the motion track produced by the foot pedal is an elliptic motion path, and the elliptic motion path is flat and gentle at the top and arc shaped at the bottom, so that the motion track produced by the user's stepping movement is ergonomic to prevent sports injuries.

2. The arm and leg compound exercise machine of claim 1, wherein the base comprises a chassis, a front cross bar installed at an end of the chassis, a U-shaped rear frame installed at the other end of the chassis, a pole extended upwardly from a center position of the front cross bar, a console installed at an end of the pole, a front connection stand and a rear connection stand extended horizontally from both front and rear side of the pole proximate to the console, a first pivot shaft pivotally coupled to the front connection stand, a second pivot shaft pivotally coupled to the rear connection stand, a front vertical bar extended upwardly and separately from both ends of the front cross bar, and a front vertical bar extended upwardly from each of both ends of the front cross bar, and an end of the front vertical bars being coupled to the first pivot shaft, a side bar extended from a position substantially the center of the chassis to each of both sides, and a rear vertical bar being extended upwardly from each end of the side bar and coupled to the second pivot shaft, and the chassis having a plurality of brackets installed thereto.

3. The arm and leg compound exercise machine of claim 2, wherein the transmission device is installed onto the plurality of brackets of the base, and the brackets are a front bracket and a rear bracket respectively, and the transmission device comprises the pulley, a belt, a cast wheel, a belt, a generator motor and an idler set, and the pulley is installed to the rear bracket, and the cast wheel is installed to the front bracket, and one of the belts is sheathed and coupled to the pulley and an axle of the cast wheel, and the idler set abuts against an outer side of the belt and is capable of absorbing a vibration force generated by the operation of the belt to reduce transmission noise and improve service life, and the generator motor is installed to the rear bracket, and the generator motor is coupled to the axle of the cast wheel by another belt, and when the pulley links the cast wheel to rotate, the cast wheel is linked by the belt to drive the generator motor to generate electric energy.

4. The arm and leg compound exercise machine of claim 1, wherein the crank unit comprises a motor, a screw extended from the motor and screwed and penetrating through a connection block, at least one slide bar locked to the connection block and slid ably penetrating through the fixed casings, and the other end of the slide bar being fixed to the adjusting block, a locking plate for coupling and fixing the motor and the fixed casings, and the fixed casings has a shaft hole and rotationally installable to an axle of the pulley of the transmission device, and the connection bar is extended from the adjusting block, and when the motor drives the screw to rotate, the rotating screw drives the connection block to displace, so as to slide the slide bar fixed to the connection block in the fixed casings, and the sliding of the slide bar drives the adjusting block for a radial movement to adjust the crank length of the crank unit.

5. The arm and leg compound exercise machine of claim 2, wherein the motion unit further comprises two pivoting brackets, two swing grips, two upper link rods, and two linkage rods which are installed on both sides of the base, and a lower end of the swing grip is installed to an upper end of the pivoting bracket, and the pivoting bracket is pivotally coupled to the second pivot shaft of the base and its pivot point acts as a rotating shaft point, and an upper end of the hollow swing arm is pivotally coupled to the first pivot shaft of the base and its pivot point acts as a rotating shaft point, and an end of the upper link rod is pivotally coupled to a lower end of the pivoting bracket and its pivot point acts as a rotating shaft point, and the other end of the upper link rod is pivotally coupled to the other pivot point of the hollow swing arm and its pivot point acts as a rotating shaft point, so that the swing grip and the hollow swing arm are coupled to each other by the upper link rod and swung synchronously, and an end of the linkage rod is pivotally coupled to a lifting device in the hollow swing arm and its pivot point acts as a rotating shaft point, and the other end of the linkage rod is pivotally coupled to the hinged frame capable of sliding on the sliding set, and the hinged frame is rotationally and pivotally coupled to the connection bar of the crank unit of the transmission unit and its pivot point acts as a rotating shaft point, and a central axis point acts as a center point and has a virtual longitudinal axis extended from the central axis point, and the rotating shaft point of the first pivot shaft and the rotating shaft point of the second pivot shaft are disposed on both lateral sides of the virtual longitudinal axis respectively.

6. The arm and leg compound exercise machine of claim 5, wherein the hinged frame is physically an n-shaped hinged frame, and the hinged frame has a pivot seat installed at the upper end of the hinged frame, a roller installed in the hinged frame, and a receiving space is defined between the hinged frame and the roller, and the other end of the linkage rod is pivotally coupled to the pivot seat of the hinged frame, and the arc slide bar of the sliding set is disposed in the receiving space between the hinged frame and the roller and slides in the receiving space.

* * * * *